US006228004B1

(12) United States Patent
Steinbach et al.

(10) Patent No.: US 6,228,004 B1
(45) Date of Patent: May 8, 2001

(54) VERSATILE PHYSICAL THERAPY APPARATUS

(75) Inventors: John M. Steinbach; Emil C. Steinbach, both of Charlotte, NC (US)

(73) Assignee: Bedside Rehabilitation Technology, Inc., Charlotte, NC (US)

( * ) Notice: Subject to any disclaimer, the term of this patent is extended or adjusted under 35 U.S.C. 154(b) by 0 days.

(21) Appl. No.: 09/105,297

(22) Filed: Jun. 26, 1998

(51) Int. Cl.[7] ..... A63B 21/02
(52) U.S. Cl. ..... 482/121; 482/904; 482/95
(58) Field of Search ..... 482/904, 121–130

(56) References Cited

U.S. PATENT DOCUMENTS 655,671 * 8/1900 Crooker et al. ..... 482/121
1,561,979 * 11/1925 Gore ..... 482/123
1,582,487 * 4/1926 Shank ..... 482/904
2,601,686 7/1952 Roessler .
3,118,441 1/1964 George .
3,826,490 * 7/1974 Mossman ..... 482/904
4,477,074 * 10/1984 Bushnell ..... 482/106
4,830,365 * 5/1989 March ..... 482/121
5,005,829 4/1991 Caruso .
5,403,257 * 4/1995 Lehtonen ..... 482/129
5,820,529 * 10/1998 Weintraub ..... 482/904

* cited by examiner

*Primary Examiner*—Jerome Donnolly
(74) *Attorney, Agent, or Firm*—Timothy R. Kroboth

(57) ABSTRACT

A versatile physical therapy apparatus is disclosed. Beneficially, the apparatus, when mounted, is adapted to be supported by an end of a bed, and includes an angularly positionable guide wheel for variation in exercise and in the muscles exercised.

16 Claims, 5 Drawing Sheets

VERSATILE PHYSICAL THERAPY APPARATUS

FIELD OF THE INVENTION

This invention relates to an exercise apparatus adapted to be mounted to a bed.

BACKGROUND OF THE INVENTION

Many types of exercise apparatus exist as illustrated by U.S. Pat. No. 3,118,441 to George. However, there are few exercise apparatus designed for use by a bed-ridden patient, whether in a hospital, nursing home, or at home. Moreover, as exemplified by U.S. Pat. No. 2,601,686 to Roessler and U.S. Pat. No. 5,005,829 to Caruso, versatility and portability are features lacking in a physical therapy apparatus for a bed-ridden patient.

SUMMARY OF THE INVENTION

In accordance with the present invention, there is provided a versatile physical therapy apparatus preferably to be used with the aid of a physical therapist. The apparatus beneficially includes a mounting member adapted to be supported by an end of a bed, a resistance element attached to the mounting member, and a guide wheel rotatably mounted in a pulley block and normally spaced apart from the resistance element. Normally, the resistance element is in a contracted or relaxed position, but in use, is extended or elongated and may as a result, closely approach the guide wheel.

Beneficially, the pulley block is pivotably mounted so that the guide wheel is angularly positionable by the user from a first selected position to a second selected position, and the pivotable mounting includes a friction-reducing element. In a preferred embodiment, the pulley block is secured to an arm extending from an elongated support to which the mounting member is secured. The apparatus further includes a pull-rope connected to the resistance element and passing over the guide wheel.

Advantageously, the elongated support includes an axial extent that accommodates variability of height of bed ends; and the apparatus further includes a mounting clamp slidably adjustable along the axial extent and including an upwardly facing jaw for engagement with a bottom portion of the bed end. In a beneficial application of angular positionability of the guide wheel, the apparatus further includes a second guide wheel connected to a fastening strap for securing the second guide wheel to a side rail of the bed.

For portability, in a preferred embodiment the mounting member and the guide wheel are attached to a lightweight frame, which includes the elongated support. In addition, the apparatus advantageously includes wheels and a handle attached to the elongated support.

Additional advantages and beneficial features of the present invention are set forth in the drawing and detailed description, and in part will become apparent to those skilled in the art upon examination of the drawing and detailed description or may be learned by practice of the invention. In the drawing and detailed description, there is shown and essentially described only a preferred embodiment of this invention, simply by way of illustration of the best mode contemplated of carrying out this invention. As will be realized, this invention is capable of other and different embodiments, and its several details are capable of modification in various respects, all without departing from the invention. Accordingly, the drawing and the detailed description are to be regarded as illustrative in nature, and not as restrictive.

BRIEF DESCRIPTION OF THE DRAWING

Reference is now made to the accompanying drawing, which forms a part of the specification of the present invention.

DETAILED DESCRIPTION OF THE INVENTION

Figure 1:
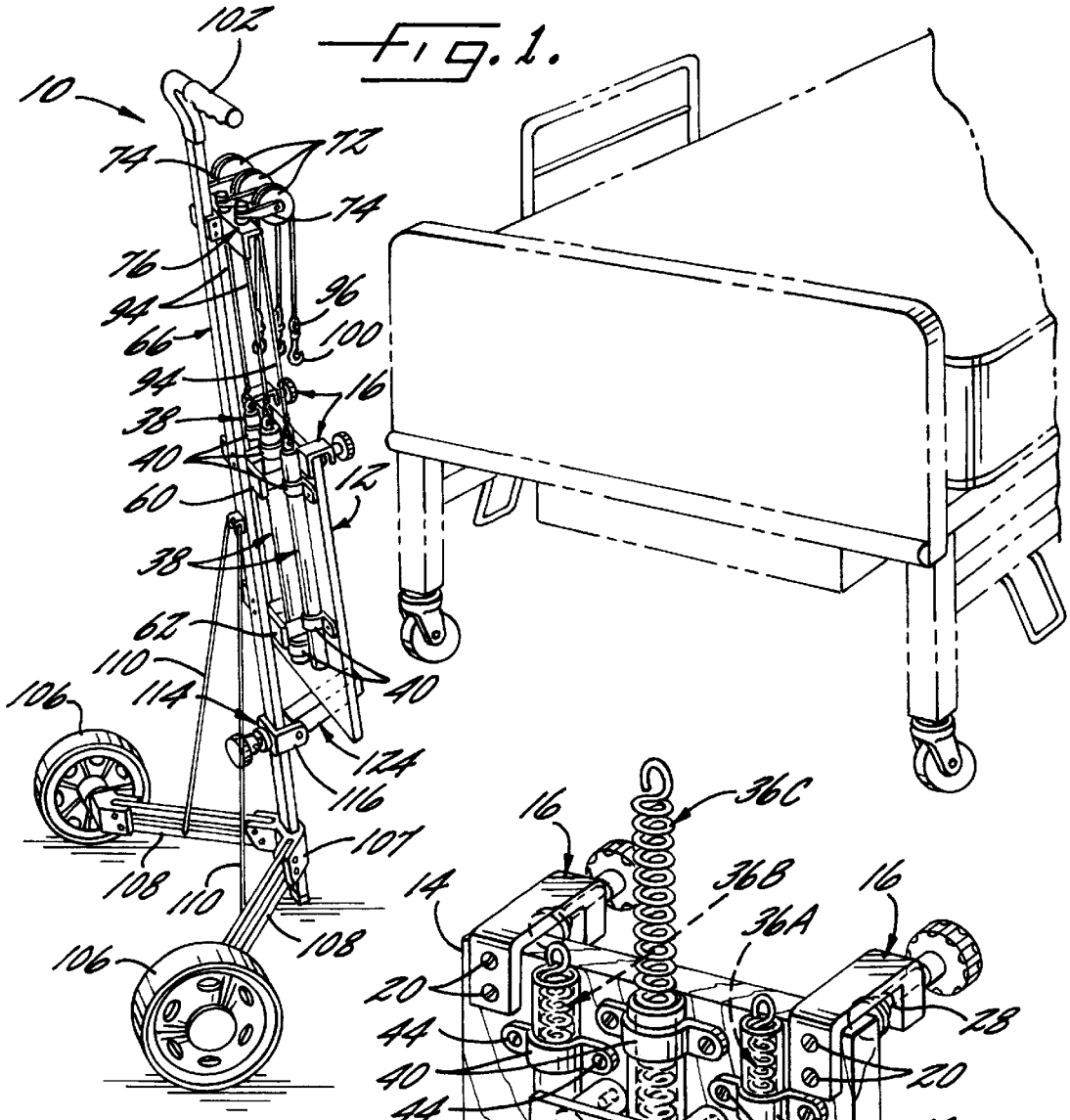
FIG. 1 is a perspective view of a preferred physical therapy apparatus in accordance with the present invention, and in phantom line, of a bed to which the apparatus is mounted.

In accordance with the present invention, a versatile physical therapy device is provided. Beneficially, the device also includes a lightweight frame on wheels. As will be understood, terms such as "upwardly", "downwardly", "upper", "lower", "above", "vertical" and the like are relative, and have been particularly used with reference to the drawing to assist understanding.

Figure 4:
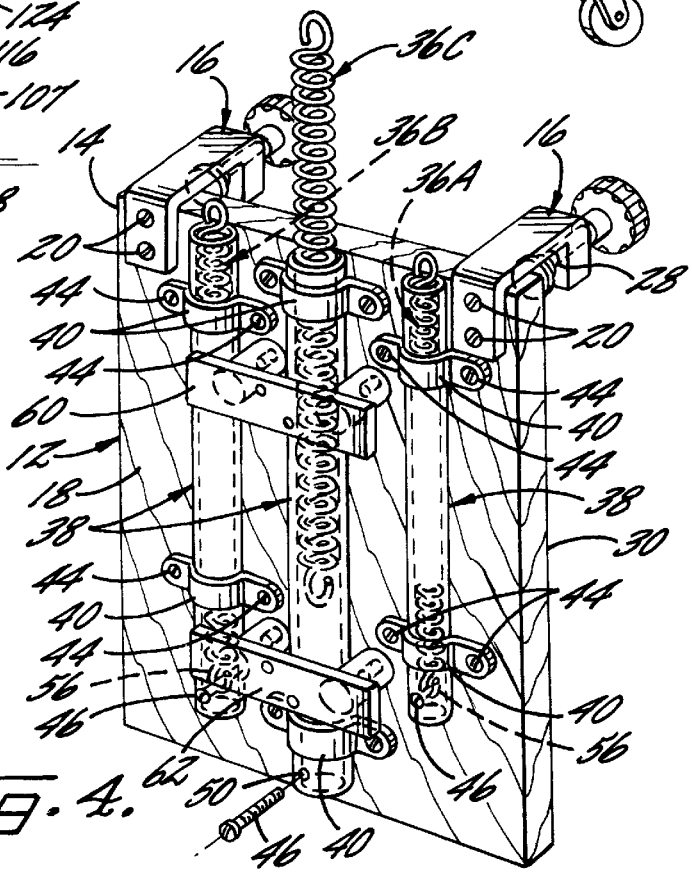
FIG. 4 is an enlarged perspective, partially assembled view of the mounting member and associated resistance elements and structure of the FIG. 1 apparatus.
Figures 2, 5:
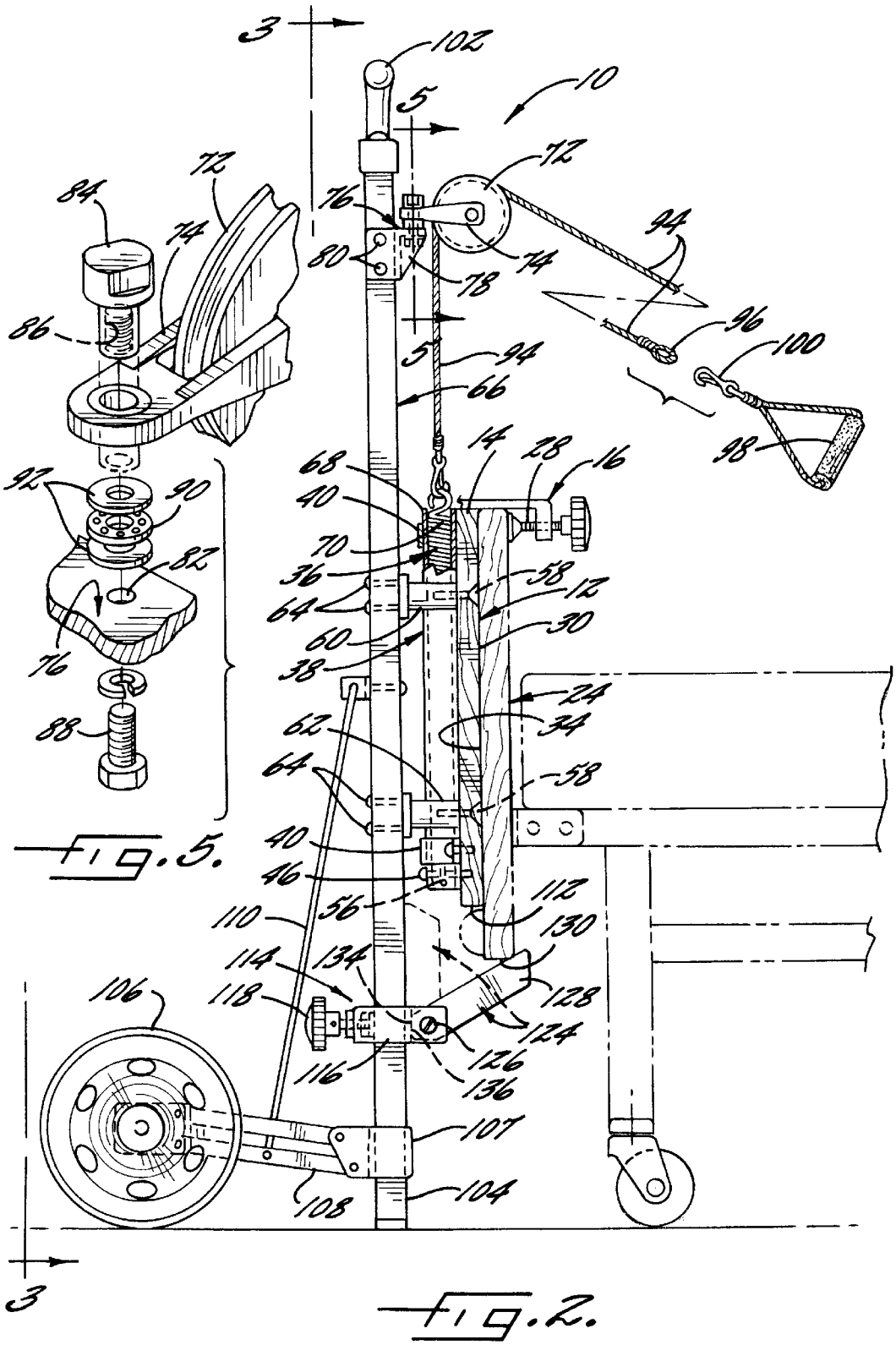
FIG. 2 is an enlarged, partially sectional side view of the apparatus of FIG. 1 mounted to a head board or foot board of a bed.
FIG. 5 is an enlarged exploded view of a preferred pivotable mount for a guide wheel, substantially along line 5—5 of FIG. 2.

With reference to FIGS. 1 to 4, a preferred physical therapy apparatus 10 in accordance with the present invention, includes a mounting block or member 12 having a top portion 14 with a pair of spaced apart, downwardly facing, U-shaped clamps 16 attached to a back side 18 of the mounting block by fasteners 20. Referring particularly to FIG. 2, clamps 16 are hooked over an end 24, in particular a head board or a foot board, of a bed, shown in phantom, and clamp bolts 28 tighten the clamps, to support mounting block 12 in an elevated position, with a generally planar, front side or face 30 of mounting block 12 in contact with an opposing generally planar face 34 of the bed end. Although the mounting block may be conveniently made of wood, other suitable materials may be used. As also will be understood, the mounting block could be a frame assembled of smaller pieces.

Figure 3:
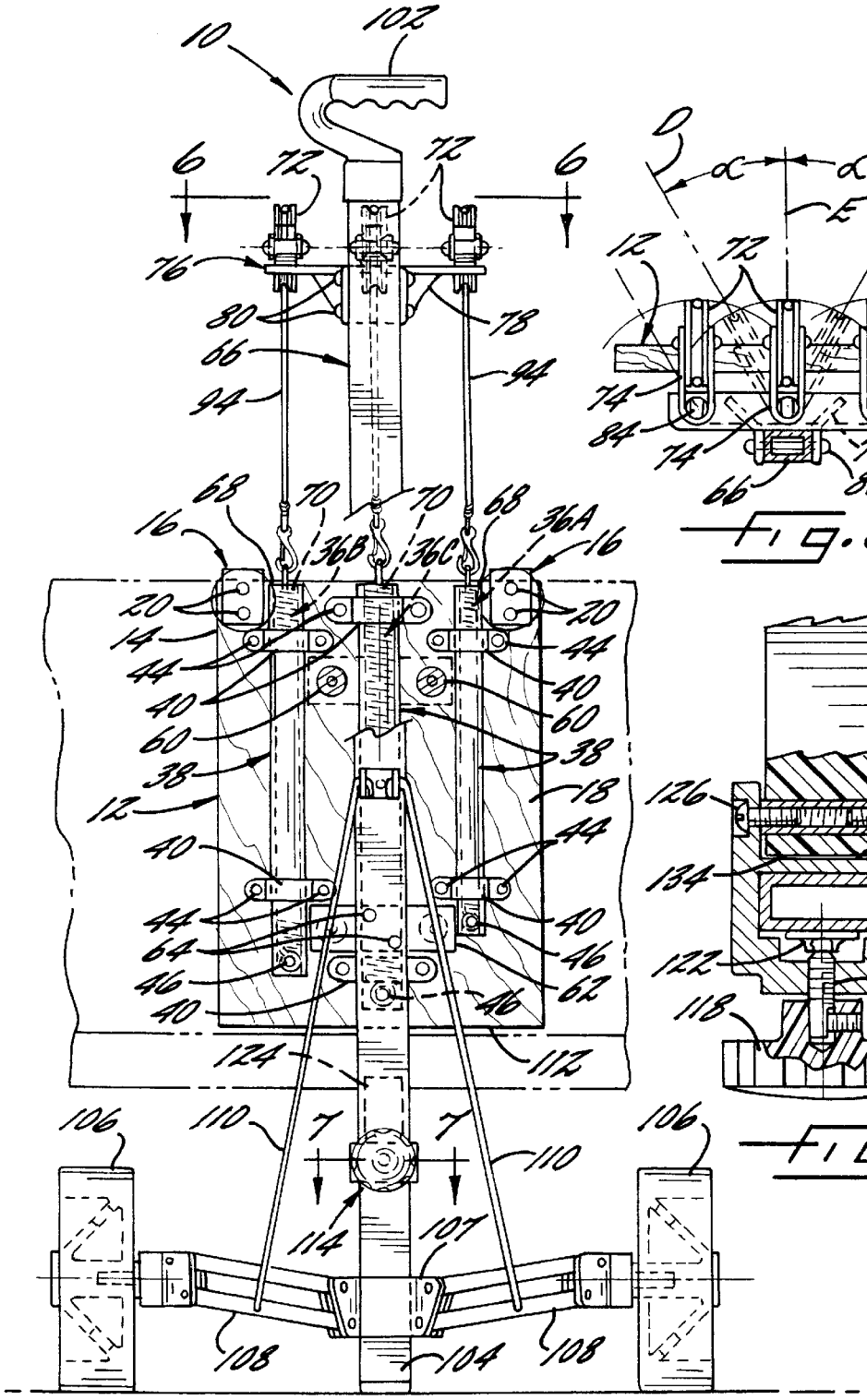
FIG. 3 is a partially sectional rear view of the mounted apparatus, substantially along line 3—3 of FIG. 2, with a portion of the support bar broken away.

Referring particularly to FIGS. 3 and 4, resistance elements 36 are conveniently attached to back side 18 of the mounting block, and beneficially are resilient tension members preferably of helical spring form disposed within elongated cylindrical tubes or pockets 38. Each tubular structure beneficially provides a protective casing for its respective elongatable member, as well as guides the elongation and contraction. Advantageously, as indicated, the axial orientation of elongated tubes 38 and resistance elements 36 is generally vertical, and each tube has an inner diameter that provides adequate mechanical clearance so that its respective resistance element is free to elongate and contract without binding. Beneficially, the resistance elements differ significantly in resistance from one another to provide the user with a selection of different resistances, and this can be accomplished in any convenient manner depending upon the type of resistance element including use of, as illustrated, a relatively lighter gauge spring 36A, a relatively heavier gauge and longer spring 36B, and an even heavier gauge and longer spring 36C. Likewise, as necessary, cylindrical tubes 38 are provided with different inner diameters. The apparatus may include any number of resistance elements; but if desired, the apparatus could be constructed with only one resistance element and related components.

With continued reference to FIGS. 3 to 4 in particular, brackets 40 including bracket mounting screws 44, and anchor pins 46 attach elongated tubes 38 to the mounting block. Conveniently, the brackets each include a generally semicircular mid-portion for surrounding the respective tube, and a pair of spaced apart brackets located near opposite tube ends, is used for each tube. Anchor pins 46 likewise attach the tension members 36 to the mounting block, and to this end, conveniently pass through holes 50 (one shown in the partially assembled view of FIG. 4) in the respective lower ends of the tubes and the aligned respective lower ends or eyelets 56 of the tension members. As will be understood, the mounting block and pockets 38 could be molded as an integral unit.

Figure 7:
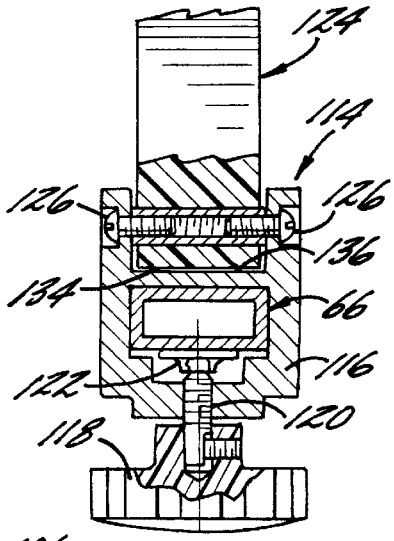
FIG. 7 is an enlarged partially sectional view of a lower clamp assembly taken substantially along line 7—7 of FIG. 3.

Referring also to FIG. 2 in particular, secured to the mounting block by fasteners 58 are a pair of spaced apart mounting brackets 60,62 which by means of fasteners 64 secure the mounting block to an elongated support bar 66. Although support bar 66 may be solid, it is beneficially, as best shown in FIG. 7, a lightweight hollow tubular member. As also shown in FIG. 7, support bar 66 conveniently has a rectangular cross-section.

Figure 6:
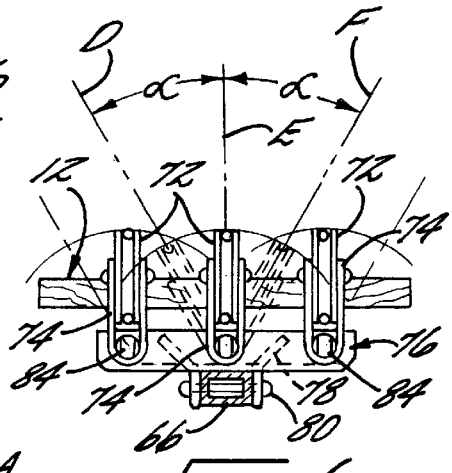
FIG. 6 is an enlarged top view taken substantially along line 6—6 of FIG. 3, which illustrates the range of angular movement of the guide wheels.

Advantageously, the axis of elongated support bar 66 is, as depicted in FIG. 2, generally vertical when the mounting block is mounted to a bed end. Referring in addition to FIGS. 3, 5 and 6 in particular, also secured to support bar 66, but located above and spaced apart from respective upper ends 68 of the elongated tubes and respective upper ends 70 of the relaxed tension members, are guide wheels 72. As indicated, each guide wheel is rotatably mounted in a pulley block 74, and is in alignment with its respective tension member; and the guide wheels and the mounting block are mounted separately to support bar 66. Beneficially, each pulley block is pivotably mounted to the support bar, and in particular to an arm 76 conveniently including a brace portion 78 and attached by fasteners 80 to the support bar. If desired, arm 76 and guide wheels 72 could be vertically adjustable on the support bar. As best shown in FIGS. 3 and 6, arm 76 extends in a plane generally perpendicular to, and is elongated transverse to, the axis of the support bar.

With reference particularly to FIG. 5, arm 76 includes apertures 82 (only one shown) for connection to the pulley blocks, and the pivotable connection between a pulley block and the arm is advantageously provided by a pivot shaft 84 with a threaded bore 86, a threaded bolt 88 which threads into the bore, and a ball bearing 90 disposed between washers 92 and positioned between the pulley block and arm 76. As will be understood, other friction-reducing elements may be chosen in place of the ball bearing. As indicated in FIG. 6, a pivotable connection permits angular movement of each guide wheel. Thus, for example, the center guide wheel (and its pulley block) may be moved within the range defined by the imaginary lines D,F from any beginning position to any selected position. For instance, the center guide wheel may be moved from a position indicated by an imaginary line E to a selected position indicated by the line F, and in that case, an angle a defines the extent of the pivotable movement. Similarly, the angle $\alpha$ defines the extent of an opposite pivotable movement from line E to line D.

Referring again to FIG. 2 in particular, beneficially connected to respective upper end 70 of each resistance element is a pull-rope 94, which passes over the respective guide wheel 72. Conveniently, an opposite end 96 of each pull-rope may be attached to a suitable grip or pull 98 by a clip 100, or as shown in FIG. 1, end 96 of the pull-rope may be provided with clip 100.

Beneficially for portability and with reference in particular to FIGS. 2 and 3, support bar 66 is provided with a handle 102, and at a lower bar end 104 is connected to wheels 106 by a bracket 107 and connecting members 108, against which support bar 66 is conveniently braced by braces 110. As will be understood, wheels 106 and connecting members 108 are also advantageously a counterweight to the pulling force exerted by the user.

Referring in addition to FIG. 7, advantageously slidably mounted on support bar 66 between bracket 107 and a bottom surface 112 of the mounting block is a mounting clamp 114 for further securing the mounting block to a bed end. Beneficially, the support bar is provided with an axial extent between bottom surface 112 (or lower mounting bracket 62, as the case may be depending upon what structure blocks upward axial movement of clamp 114) and bracket 107 that provides for a wide range of axial movement of clamp 114 to accommodate various bed ends.

As best seen in FIG. 7, mounting clamp 114 includes a sleeve-like bracket 116 which surrounds the support bar, and a rotatable knob 118 and a threaded shaft 120 which extends from knob 118 through bracket 116 and includes a ball portion (not shown) at its end held within a foot member 122 for tightening or loosening the clamp from its selected vertical position on the support bar. Clamp 114 further includes an elongated jaw 124 attached to sleeve-like bracket 116 and pivotably movable about an axis formed by fasteners 126 from, now referring to FIG. 2, a closed position (shown in dotted line) to a upwardly facing open position for engagement of a jaw end 128 with a bottom surface 130 of the bed end. As can be understood from FIG. 2, jaw 124 includes a beveled surface 134 opposite to jaw end 128 which upon contact with a surface 136 of sleeve-like bracket 116 stops further opening of the jaw so that the jaw is upwardly angled in the open position.

Figure 8:
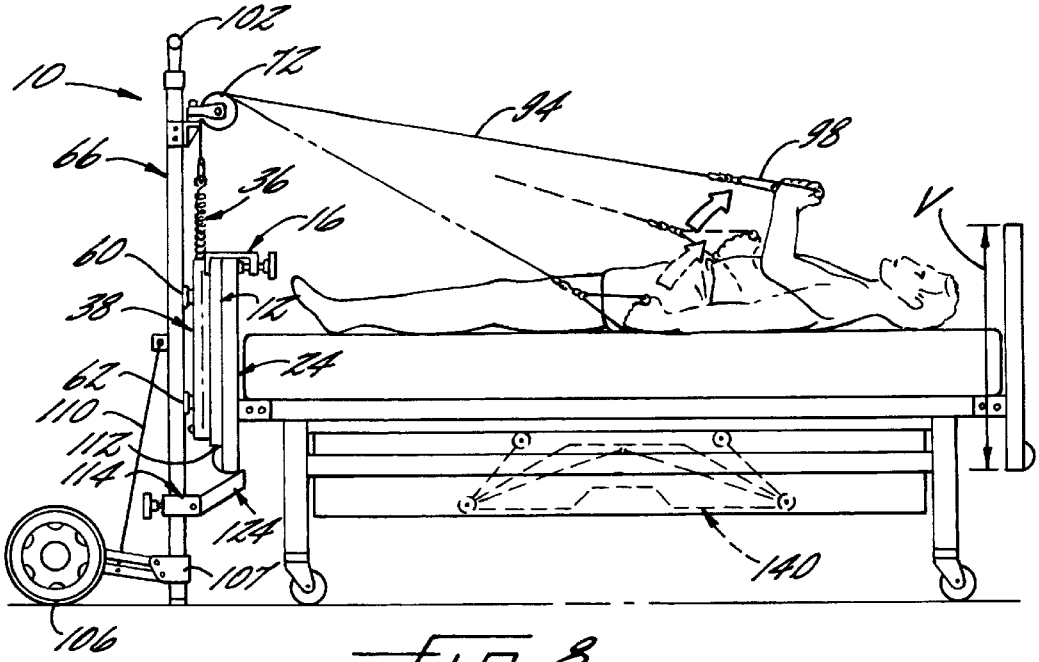
FIGS. 8 to 10 illustrate usage and further illustrate mounting, of the apparatus of FIG. 1, with FIG. 10 illustrating a particularly advantageous application of the angular pivotability of the guide wheels.
Figure 9:
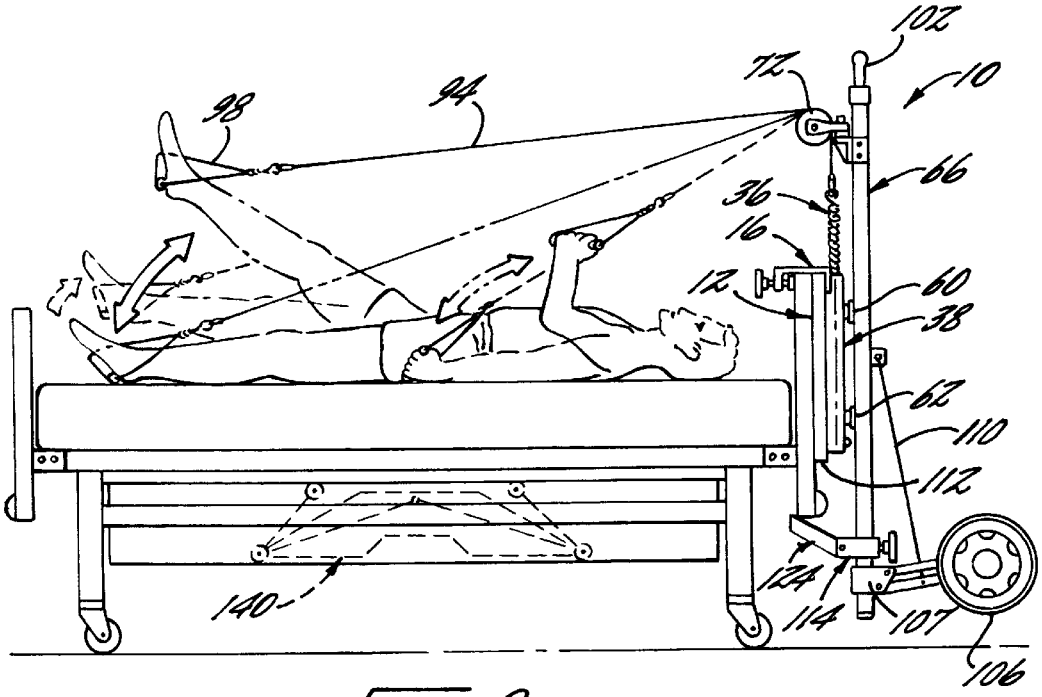
Figure 10:
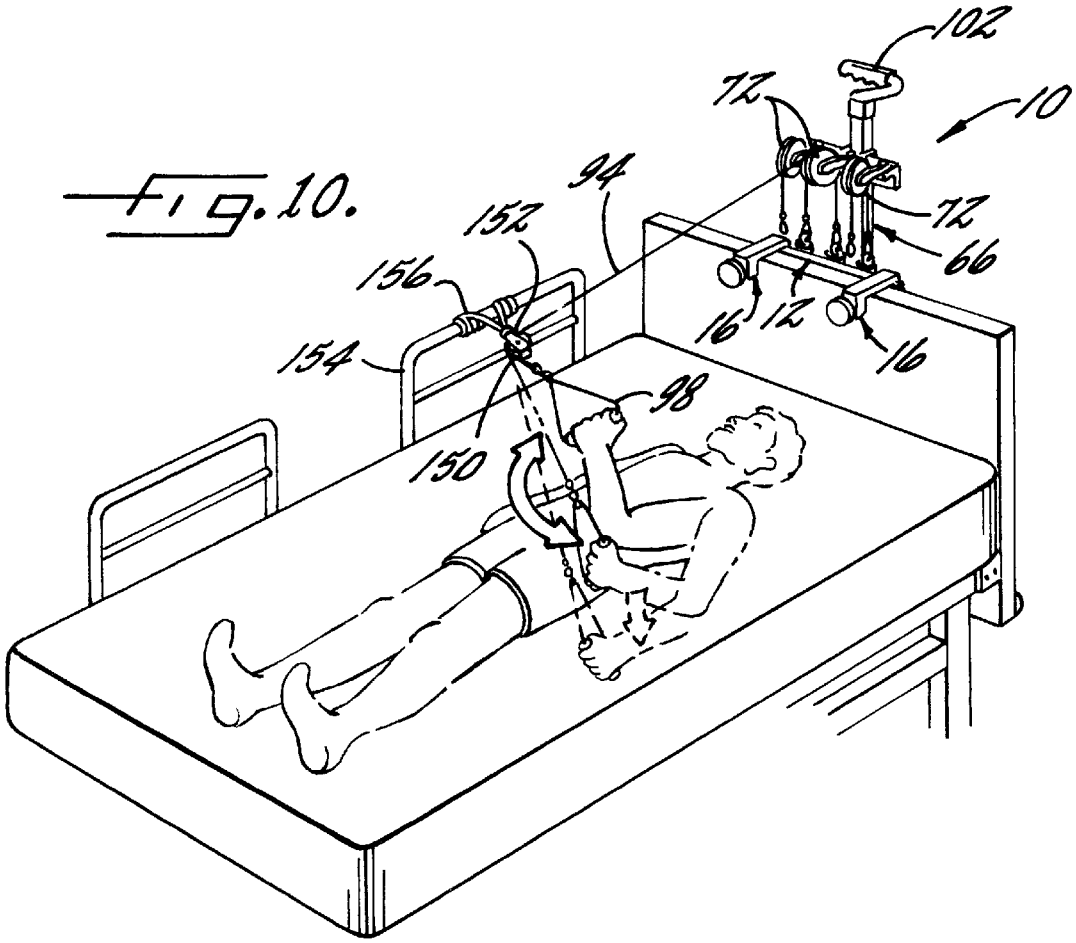

In use and with reference also to FIGS. 8–10, physical therapy apparatus 10 is wheeled up to bed end 24, conveniently with vertically adjustable mounting clamp 114 positioned directly above bracket 107 and pivotable jaw 124 of clamp 114 in an open position. As indicated by an adjustment mechanism 140, shown in phantom in FIGS. 8 and 9, the distance of the bed foot board and headboard from the floor is vertically adjustable. Thus, the foot board elevation may be conveniently lowered so that the opposing faces of mounting block 12 and foot board 24 contact one another, and thereafter the foot board elevation is raised so that the top of the foot board is within U-shaped clamps 16. Then, vertically adjustable mounting clamp 114 is moved upwardly along the axis of the support bar until jaw 124 engages the bottom of the foot board. After mounting clamps 16 and 114 have been tightened to secure apparatus 10 to the bed, and pulls 98 have been attached to pull-ropes 94, apparatus 10 is ready for use, without any lifting of the apparatus by the user or physical therapist.

As indicated in FIG. 8 and with reference to the directional arrows, apparatus 10 is useful for arm curls when mounted to the foot board. If desired, both arms may be exercised simultaneously. Although mounting to a head board is similar, often a head board differs in vertical dimension (or height), indicated as V in FIG. 8, from the foot board, and in any event, head boards, as well as foot boards, vary in height. Thus, as indicated in FIG. 9, the vertical position of mounting clamp 114 on support bar 66 is lower than in FIG. 8 because the head board has a greater height than the foot board. Accordingly, the axial extent of the support bar above bracket 107 and the vertical adjustability of clamp 114 beneficially accommodate different heights of head boards and foot boards. As shown in FIG. 9, wheels 106 can be elevated off the floor, and resistance element 36 is placed into tension by elongation. As illustrated in FIG. 9 and with reference to the directional arrows, apparatus 10 is useful for exercising different muscle groups when mounted to a head board than when mounted to a foot board. Thus, a bed-ridden patient may also do arm pulls and leg lifts.

FIG. 10 illustrates a particularly advantageous application of the angular pivotability of guide wheels 72. In this use, a guide wheel 150 rotatable mounted in a pulley block 152 is attached to a bed side rail 154 by a suitable fastening strap 156, and pull-rope 94 passes over guide wheel 150 also. As a result, additional muscles may be exercised, and variation is provided for exercise. As will be readily apparent, the angular pivotability of guide wheels 72 advantageously provides for variation in exercise and in the muscles exercised, without the specific application shown in FIG. 10.

Various modifications may be made to apparatus 10. One such modification is to make the apparatus with only one elongated tube or pocket, and to provide a plurality of resistance members of different resistances to be substituted one for another in the pocket. It is therefore apparent that the present invention may be carried out with various modifications without departing from the spirit or essential attributes thereof.

Accordingly, reference should be made to the appended claims as indicating the scope of the invention.

What is claimed is:

1. A versatile physical therapy apparatus comprising a pivotable pulley block, a support for said pulley block, rotatable members connected to said support for moving said apparatus to and from a bed when not mounted to the bed, a mounting member attached to, said support, said mounting member adapted to be supported by a bed and comprising a face to which a resistance element is attached and by attachment to which said resistance element is restrained, a guide wheel rotatably mounted in said pulley block, said pulley block being pivotably fastened by a stud to an arm fixed to said support, for said guide wheel to be angularly positionable to a selected position, and a pull-rope connected to said resistance element and passing over said guide wheel.

2. The apparatus of claim 1, wherein said support is elongated, and said rotatable members comprise wheels attached to an end of said elongated support further comprising, a mounting clamp slidably adjustable along said support, and a handle on said elongated support.

3. The apparatus of claim 1, wherein said pulley block is mounted on said arm.

4. The apparatus of claim 1, wherein said arm includes an aperture and said stud passes through said aperture, and said support is elongated and has a generally vertically positioned axis when said mounting member is mounted to said bed.

5. The apparatus of claim 1, wherein said stud is a pivot shaft.

6. The apparatus of claim 1, wherein a friction-reducing element is disposed between said pulley block and said arm.

7. The apparatus of claim 6, wherein said friction-reducing element is a ball bearing.

8. The apparatus of claim 1, wherein said resistance element is a helical spring disposed in a cylindrical tubular member.

9. The apparatus of claim 1, wherein said mounting is spaced apart from said support, and said mounting member comprieses a face for contact with a bed end, and said resistance element is attached to an opposite face of said mounting member.

10. The apparatus of claim 4, wherein said arm further comprises a plurality of the apertures in spaced apart relationship to one another, and a plurality of pivotable pulley blocks each provided with a pulley rope, are fastened in spaced apart attachment to said arm.

11. A versatile physical therapy apparatus comprising a pivotable pulley block, an elongated support for said pulley block, a mounting member secured to said support and adapted to be supported by a bed, a guide wheel rotatably mounted in said pulley block, said pulley block being pivotable for said guide wheel to be angularly positionable to a selected position, a pull-rope connected to a resistance element and passing over said guide wheel, and a clamp slidably adjustable along said elongated support and comprising a bracket to which a pivotable jaw for engagement with a bottom portion of a bed end, is pivotably connected.

12. The apparatus of claim 11, wherein said bracket is a sleeve-like bracket disposed around said support, and said pivotable jaw is upwardly facing in an open position for said engagement and includes a beveled surface which upon contact with said bracket limits pivoting of said pivotable jaw.

13. The apparatus of claim 11, wherein said elongated support comprises an axial extent that accommodates variability in height of bed ends from a support surface.

14. The apparatus of claim 11, further comprising wheels attached to said support for wheeling said apparatus to or from a bed end when not mounted to said bed end, wherein said mounting member is disposed between said pulley block and the clamp bracket.

15. A mobile and versatile physical therapy apparatus mounted to a bed comprising a side rail, said physical therapy apparatus comprising a pivotable pulley block, a support for said pulley block, a mounting member supported by an end of said bed and secured to said support, wheels attached to said support for wheeling said apparatus to or from said bed when not mounted to said bed end, a guide wheel rotatably mounted in said pulley block, and angularly positionable to a side position, said pulley block being pivotable for said guide wheel to be angularly positionable to said side position, a second guide wheel secured to said side rail, and a pull-rope connected to a resistance element and passing over said guide wheel mounted in said pulley block and said second guide wheel.

16. The apparatus of claim 15, further comprising a handle on said support.

* * * * *

UNITED STATES PATENT AND TRADEMARK OFFICE

CERTIFICATE OF CORRECTION

PATENT NO. : 6,228,004 B1
DATED : May 8, 2001
INVENTOR(S) : John M. Steinbach et al.

It is certified that error appears in the above-identified patent and that said Letters Patent is hereby corrected as shown below:

Title page,
Item [56], "References Cited", U.S. PATENT DOCUMENTS", insert -- 4,826,153 5/1989 Schalip --; and -- 5,385, 525 1/1995 Davis --.
Item [56], "References Cited", insert -- FOREIGN PATENT DOCUMENTS
755763 8/1956 United Kingdom
2257921 1/1993 United Kingdom --.

Claim 1, column 5,
Line 53, delete "," after "attached to";
Line 55, delete "comprising a face";
Line 58, after "block", insert -- and angularly positionable to a side position --;
Line 59, after "support", delete ",";
Line 60, delete "to a selected position".

Claim 2, column 5,
Line 65, before "further", insert -- , --;
Line 66, after "comprising", delete ",".

Claim 9, column 6,
Line 17, after "mounting", insert -- member --;
Line 19, "comprieses" should read -- comprises --.

Claim 15, column 6,
Line 59, delete "," before "and angularly".

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*